United States Patent [19]

Perrella

[11] 4,095,712

[45] Jun. 20, 1978

[54] CONTAINER HAVING SECONDARY HINGED CLOSURE

[76] Inventor: Emilio Perrella, Via S. Carlo 13, Segrate (Milan), Italy

[21] Appl. No.: 776,773

[22] Filed: Mar. 11, 1977

[30] Foreign Application Priority Data

Oct. 22, 1976 Italy ..... 28631 A/76

[51] Int. Cl.[2] ..... B65D 51/18

[52] U.S. Cl. ..... 220/254; 220/281; 220/339; 222/556

[58] Field of Search ..... 220/254, 263, 281, 338, 220/339, 306; 215/301, 237; 222/556; 206/540

[56] References Cited

U.S. PATENT DOCUMENTS

| | | | |
|---|---|---|---|
| 3,760,972 | 9/1973 | McKirnan | 220/254 X |
| 3,964,609 | 6/1976 | Perrella | 220/254 X |

*Primary Examiner*—George T. Hall

*Attorney, Agent, or Firm*—Holman & Stern

[57] ABSTRACT

This invention relates to a container for distributing solid loose products such as lozenges, sugar coated sweets and the like. According to the invention the container comprises a containing body and a closure lid, which is formed by an at least partially resilient plastics material. The upper base of the lid includes a delivery port, which is closed by a flap element formed as a single piece with the remaining part of said upper base. Said remaining part is elastically deformable between rest and delivery positions in which said flap element closes and opens said delivery port, respectively.

3 Claims, 7 Drawing Figures

Fig.1
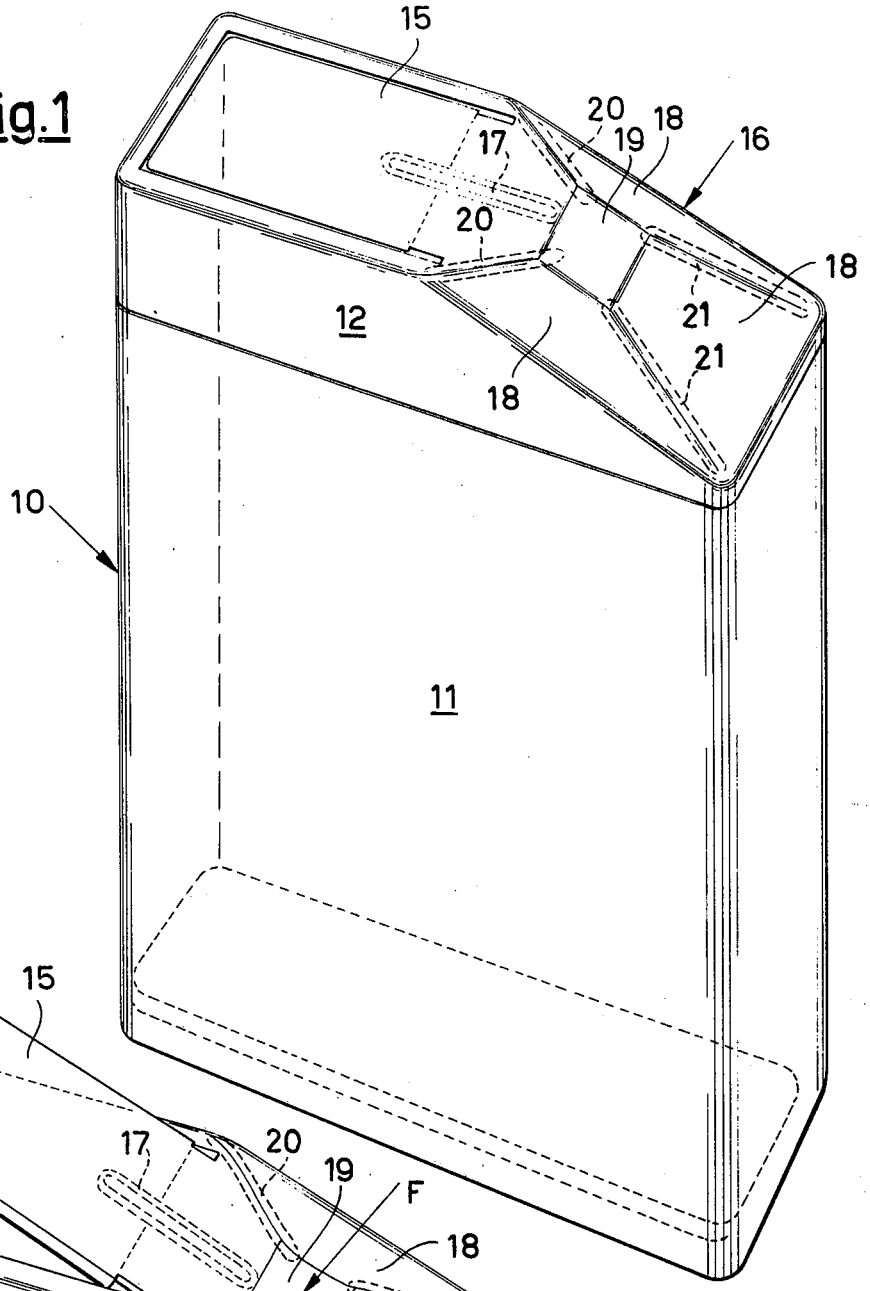
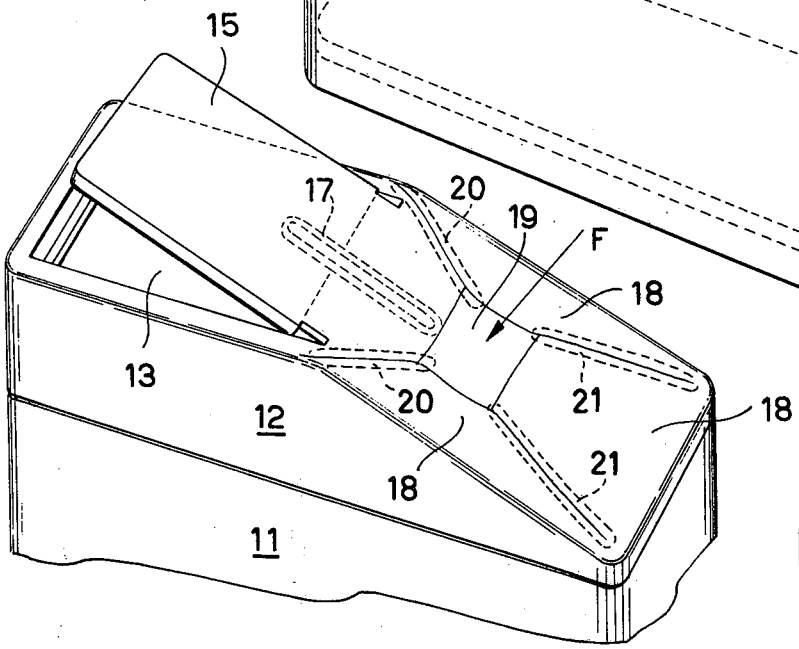
Fig.2

CONTAINER HAVING SECONDARY HINGED CLOSURE

This invention relates to a container for distributing solid loose products such as lozenges, sugar coated sweets and the like, which hereinafter will be generally referred to as articles to be distributed or delivered. More particularly, the present invention relates to the closure device for the delivery container which allows the controlled distribution of one or more articles, the container then being closed automatically as soon as the operation of the device ceases.

In the case of small sized products to be swallowed, such as confectionery in the form of sugar coated sweets, lozenges and the like, the container must satisfy various requirements.

In this respect, on the one hand the container must satisfy rigid hygiene requirements as in most cases it has to contain articles for distribution which are not individually wrapped and protected by paper or the like. On the other hand, such confectionery is normally of very low cost and the container must therefore not form a substantial part of the pack to be sold, otherwise it will no longer be competitive.

Finally, the appearance of the container is of no less importance, and has great influence on the sale of the product.

Up to the present time the most widely used containers for articles of this type have consisted of tubes provided with a screw or press cap, or boxes with a hinged lid, both these being normally constructed by pressing light metal.

Containers are also known in which the lid is slidable or rotatable relative to the container body in order to uncover a delivery slot.

Recently use has been made of plastics moulded containers of substantially parallelepiped shape provided with a lid hinged to one of the minor bases of the parallelepiped to partially close the base.

All these briefly mentioned containers require a separate non-automatic closing operation after delivering one or more articles.

Furthermore, with use, the closure of the lid or the like may become ineffective or no longer satisfactory.

The main object of the present invention is to provide a new container distributor for small sized solid articles, in particular confectionery such as sugar coated sweets, lozenges and the like, provided with a distribution closure device which may be operated by one hand closes automatically after each distribution of at least one article.

A further object of the present invention is to provide a container of the said type in which both the container body and the closure device are constructed entirely by plastics moulding.

These and further objects of the present invention are attained by a container distributor for small sized articles, in particular confectionery such as sugar coated sweets, lozenges and the like, of the type comprising a part forming the containing body and a part forming the lid, at least this latter being of an at least partially resilient material, in the upper base of which there is provided a delivery port arranged for closing by a flap element, wherein at least the remaining portion of said upper base, which extends into said flap element and is formed as a single piece with said part forming the lid, is elastically deformable between a rest position and a delivery position in which said flap element closes and opens said delivery port respectively.

In the preferred embodiment of the present invention, said remaining portion of said upper base is configured with suitable bevels relative to the general parallelepiped form of the container in order to facilitate said elastic deformation of this portion. In particular, and more preferably, said remaining portion is in the form of a pyramid trunk, with one side forming a single rigid piece with said flap element and the other three walls being of reducing thickness, in particular from the minor base towards the major base.

The special aspects and advantages of the present invention will be more evident from the detailed description given hereinafter by way of example with reference to the accompanying drawings, in which:

FIG. 1 is a general perspective view of the container distributor according to the present invention;

FIG. 2 is a partial view showing the container distributor in the delivery state;

Figure 3:
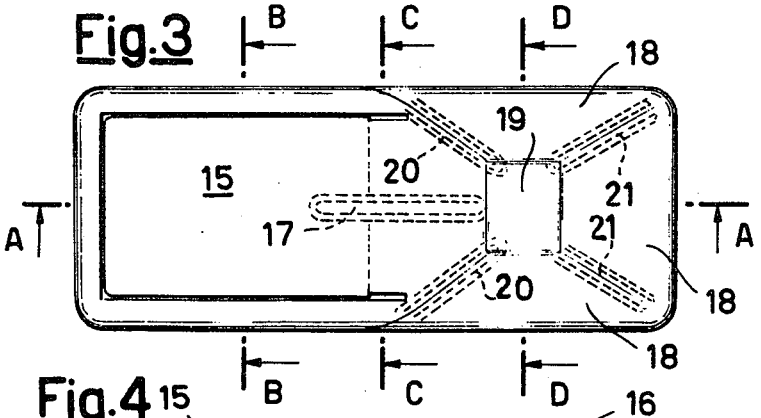
FIG. 3 is a plan view of the container distributor from above.
Figure 4:
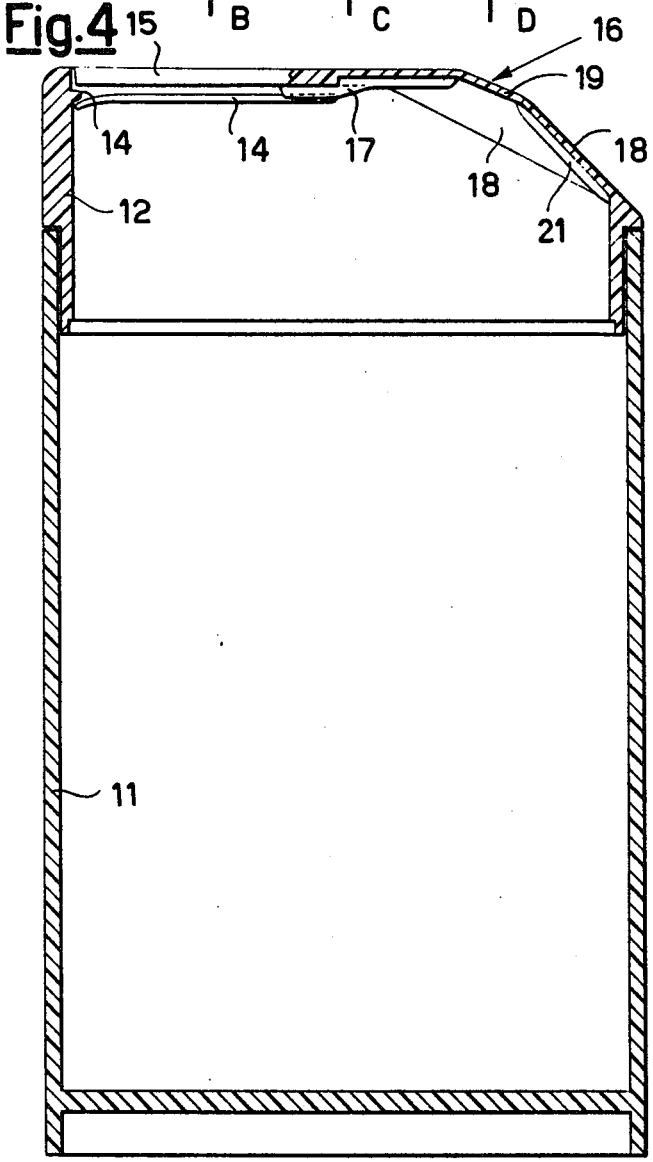
FIGS. 4, 5, 6 and 7 are sections on the lines A—A, B—B, C—C and D—D.
Figure 5:
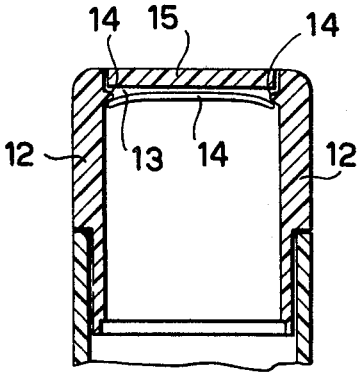
Figure 6:
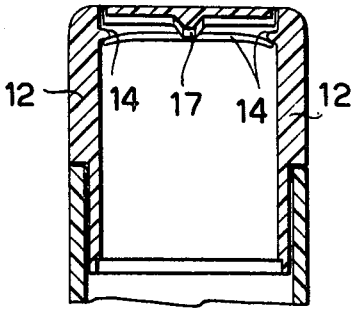

The drawings show a delivery container 10 used particularly for packaging confectionery in the form of lozenges, sugar coated sweets and the like, comprising a part 11 constituting the actual containing part, and a part forming a lid 12 which mates with the part 11 and closes it, for example in the manner of a slip-on lid, and is arranged to deliver the contents of the container distributor when operated.

The purpose of this construction in two slip-on or otherwise connecting parts is to facilitate industrial filling of the contents, and it is apparent that the container 10 may also be constructed as a single piece.

The lid 12 comprises in its upper base a delivery aperture 13 surrounded on three sides by a support and arresting rib 14, on which a flap closure element 15 rests when the container 10 is closed.

The flap element 15 is in fact free on three sides in the upper base of the lid 12, and its fourth side is rigidly connected to the rest of said upper base. Preferably the connection between the flap element 15 and the remaining part of said upper base, indicated for simplicity by the general reference numeral 16, is made more rigid by a stiffening rib 17.

In the preferred embodiment, the said part 16 formed in one piece with the lid 12 is bevelled on at least three sides so as to define a truncated pyramid indicated by 18, in which the upper or minor base 19 serves as a surface for applying the pressure for operating the flap 15.

By virtue of the said bevels, the part 16 on being subjected to pressure applied to the surface 19 (in the manner indicated by the arrow F in FIG. 2) passes from its normal (or rest) configuration of FIG. 1 to the configuration of FIG. 2 in which the flap element 15 has turned upwards by virtue of the rigidity of the connection, and uncovers the delivery port 13.

On releasing the pressure, the part 16 reassumes the configuration of FIG. 1 by natural resilience.

Figure 7:
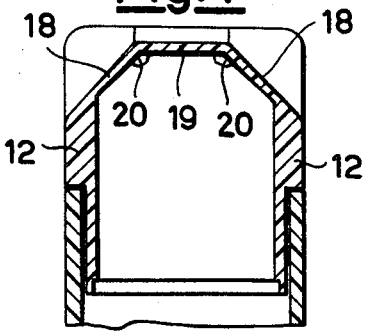

In order to facilitate the opening and closing movement without changing the mechanical strength of the container and in particular of the lid, which is the part subjected to greatest stress, the part 16 is made according to the present invention with differing thicknesses as shown in FIG. 7, i.e. by making the truncated pyramid part with a lesser thickness decreasing from the minor base to the major base. Clearly this thickness reduction is not applied to the pressure surface 19 nor to the ribbed part connecting to the flap element 15.

In obtaining reliable operation repeatable over a large number of times, the strengthening ribs provided at the edges of the truncated pyramid part, and especially at the front edges, are very important, these latter being indicated by the reference numeral 20, whereas the rear ones are indicated by the reference numeral 21.

The preceding description relates to one preferred embodiment, but this is susceptible to conceptually and structurally equivalent modifications.

For example, a spherical cap or truncated conical configuration could be used instead of the truncated pyramid structure.

In the preferred embodiment, the part 16 returns to its rest configuration by the natural resilience of the material and in particular by the action of the edge ribs 20 and 21.

It would however be equally possible to make the dimensions and thicknesses (in particular the axial height) of the truncated pyramid (or spherical cap) portion such that the pressure exerted on the surface 19 brings this portion into another stable position in which the flap element remains open until a similar pressure is exerted on the flap element itself, causing said portion to resiliently return to the rest configuration with the delivery port closed.

In a further modification, the two faces of the truncated pyramid part parallel to the major sides of the container may be weakened by a notch at the position of connection to the adjacent edge of the lid, i.e. at the major base of the truncated pyramid.

It is evident that in both cases the fundamental condition of single handed operation is respected, i.e. using the thumb or index finger of the hand for delivery, while the hand holds the container body 11.

Even though explicit reference has been made in the preceding description to container distributors for confectionery, this reference must not be taken as limiting, either with regard to the use or to the various container proportions.

What I claim is:

1. A container distributor of the type comprising a part forming the containing body and a part forming the lid, at least this latter being of an at least partially resilient plastics material, a delivery port being provided in the upper base of said part forming the lid and arranged for closing by a flap element, wherein at least the remaining portion of said upper base, which extends into said flap element and is formed as a single piece with said part forming the lid, is elastically deformable between a rest position and a delivery position in which said flap element closes and opens said delivery port respectively;

said remaining portion being configured as a truncated pyramid with the minor base facing upwards and constituting the application surface for the pressure opening the flap element, said remaining portion comprising walls of lessening thickness from the minor base towards the major base, except on the face integrally connected to said flap element; and said face integrally connected to the flap element is provided with at least one stiffening rib.

2. A container as claimed in claim 1, wherein said delivery port is bounded on the inside of said lid by a rib projecting inwards from each of the three adjacent sides.

3. A container distributor as claimed in claim 1, wherein in said truncated pyramid part at least the edges adjacent to the face connected rigidly to the flap element are strengthened by ribs.

* * * * *